United States Patent [19]

Korenko

[11] 4,435,231

[45] Mar. 6, 1984

[54] COLD WORKED FERRITIC ALLOYS AND COMPONENTS

[75] Inventor: Michael K. Korenko, Wexford, Pa.

[73] Assignee: The United States of America as represented by the United States Department of Energy, Washington, D.C.

[21] Appl. No.: 364,050

[22] Filed: Mar. 31, 1982

[51] Int. Cl.[3] ..... C21D 8/04

[52] U.S. Cl. ..... 148/12 EA; 148/37

[58] Field of Search ..... 148/12 EA, 12.3, 37

[56] References Cited

U.S. PATENT DOCUMENTS 3,141,800 7/1964 Reichenbach ..... 148/12.3

3,347,715 10/1967 Pfeil ..... 148/12.3

4,049,431 9/1977 Hagel et al. ..... 75/126 C

*Primary Examiner*—W. Stallard

*Attorney, Agent, or Firm*—John J. Prizzi

[57] ABSTRACT

This invention relates to liquid metal fast breeder reactor and steam generator precipitation hardening fully ferritic alloy components which have a microstructure substantially free of the primary precipitation hardening phase while having cells or arrays of dislocations of varying population densities. It also relates to the process by which these components are produced, which entails solution treating the alloy followed by a final cold working step. In this condition, the first significant precipitation hardening of the component occurs during high temperature use.

16 Claims, 2 Drawing Figures

COLD WORKED FERRITIC ALLOYS AND COMPONENTS

BACKGROUND OF THE INVENTION

The present invention was made or conceived during the performance of work under Contract No. EY-76-C-14-2170 with the Department of Energy.

This invention relates to high strength ferritic alloys for use in high temperature, and high energy neutron radiation environments. More specifically it relates to fully ferritic precipitation hardening alloys and their thermomechanical processing.

Various materials have been considered and are in the process of being evaluated for use as heat transfer material (cladding) and structural (e.g. ducts) materials in liquid metal fast breeder reactors and steam generator turbine applications. These materials have included, for example, austenitic solid solution strengthened alloys, austenitic precipitation hardening alloys and ferritic alloys. The ferritic alloys include, for example, those high strength alloys described in U.S. Pat. No. 4,049,431. The ferritic alloys described in this application are precipitation hardening materials and have been in the past processed to an aged final condition.

According to the present invention it has been found that precipitation hardening ferritic alloys when manufactured to a cold worked final condition possess improved swelling properties at elevated temperatures when exposed to fast neutron (E>0.1 MeV) fluxes compared to the identical material placed in pile in an aged condition. In the present invention a ferritic precipitation hardening alloy is solution treated, cold worked, and then placed in its intended application, wherein the first significant precipitation hardening of said alloy after the last cold working step occurs.

The process is particularly applicable to the fully ferritic precipitation hardening alloys described in U.S. Pat. No. 4,049,431. These alloys, sometimes described as precipitation hardening delta ferritics, are generally characterized by the following chemistry (in weight percent): about 9 to 13 chromium; about 4 to 8 molybdenum; about 0.2 to 0.8 silicon; about 0.2 to 0.8 manganese; about 0.04 to 0.12 carbon; and the balance being essentially iron. Preferably, the alloy chemistry should be as follows: about 9.5 to 11.5 chromium; about 5.5 to 6.5 molybdenum; about 0.04 to 0.07 carbon. In addition, alloys of this type may also include about 0.1 to 0.3 vanadium and 0.2 to 0.8 niobium. The niobium being preferably held to a range of 0.3 to 0.6.

For fast breeder reactor applications it is believed that optimum in pile properties of long term mechanical stability and swelling resistance will be achieved if the precipitation hardening ferritics of U.S. Pat. No. 4,049,431, especially alloy D57, are modified to include about 0.1 to 1.0 weight percent nickel, and more preferably about 0.4 to 0.6 weight percent nickel, and are processed in accordance with the present invention.

The above fully ferritic alloys to which the present invention applies may in general be melted, cast into ingots, and the ingots initially processed to an intermediate size by soaking, forging, and hot rolling, as described in U.S. Pat. No. 4,049,431. The material is then typically cold worked to final size in one or more cold working steps, having anneals prior to each step. These anneals should be at a temperature and time sufficient to recrystallize the material and place most precipitates into solution. However, the temperature and the time at temperature should not be so great as to cause excessive grain growth and significant precipitation at the grain boundaries which will lead to a significant reduction in the ductility and toughness of the material, making it difficult to further cold form without cracking. It is believed that these requirements can be met in alloys D57 and D57B if the material is annealed at a temperature between approximately 1000° and 1150° C. for about 5 minutes to 1–2 hours at temperature. It is however preferred that this anneal be performed at a temperature of about 1000° to 1075° C. for 5 to 30 minutes. According to the present invention there is no annealing or aging treatment after the final cold working step which comprises about a 10 to 50 percent reduction in cross sectional area of the piece after the last anneal.

DETAILED DESCRIPTION OF THE INVENTION

Table I shows the chemistry of the precipitation hardening delta ferritics which were processed in accordance with the present invention. Both the nominal and analyzed chemistries are shown. It will be noted that the only significant chemical difference between alloy D57 and D57B is the addition of approximately 0.5 weight percent nickel to the D57B composition. The D57 heat shown in Table I is identical to the heat of D57 evaluated in U.S. Pat. No. 4,049,431. The cast ingot was soaked at approximately 1175° C. for 2 hours. It was press forged at about 1175° C. to a 0.5 inch thick plate. The plate was then hot rolled at about 1175° C., with reheats after each reduction, to a hot rolled thickness of approximate 0.060 inches. This hot rolled section was vapor blasted, and then annealed and cold rolled in a series of steps as shown in the FIG. 1 flow diagram.

The section, was first given a Type I anneal which is a vacuum anneal comprising heating the section up to an annealing temperature of approximately 1038° C. over a period of about 1.5 hours, soaking it at temperature for about 1. hour and then allowing it to furnace cool over a period exceeding 4 hours. The material was then given a cold rolling reduction of 23%, followed by another Type I anneal and a subsequent cold rolling reduction of 29% to an approximate thickness of 0.031 inch. At this point the material was then sectioned into two portions, A and B.

Figure 1:
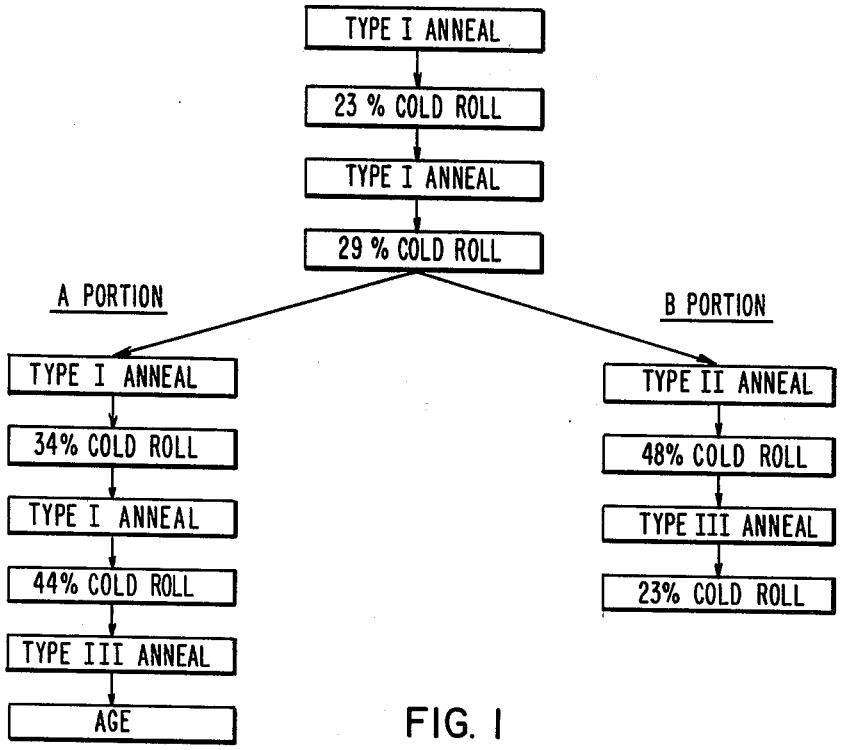
FIG. 1 shows a flow diagram of an embodiment of the D57 material processing.

The A portion material was processed as shown in the lefthand column of FIG. 1. It was given a Type I anneal, followed by a cold rolling reduction of 34 percent, another Type I anneal, and a final cold rolling reduction of 44 percent. This material was given a Type III anneal which comprises soaking the material at approximately 1149° C. for about 30 minutes, followed by air cooling. The material was then precipitation hardened by aging it about 732° C. for approximately 1. hour, followed by air cooling. Samples of the A portion material, now in the annealed and aged condition, were exposed to fast neutron (E>0.1 MeV) fluxes to determine the materials' swelling characteristics in this final condition.

The B portion material was processed as shown in the righthand column of FIG. 1. It was given a Type II anneal which comprises soaking the material at approximately 1100° C. for about 15 minutes followed by an air cool. The B portion material subsequently received a cold rolling reduction of 48 percent, followed by a Type III anneal and a final cold rolling reduction of 23%. Samples of the B portion material, now in the cold worked condition, according to the present invention, were then exposed to fast neutron fluxes to determine the swelling characteristics of the material in this final condition.

Table II lists the swelling data obtained for the two material conditions at various temperatures and fluences. It is readily apparent from a comparison of the swelling data of the two material conditions that while the D57 material in the cold worked condition is still in a densifying mode the D57 material in the annealed and aged condition at 427° C. and 482° C. is swelling.

Figure 2:
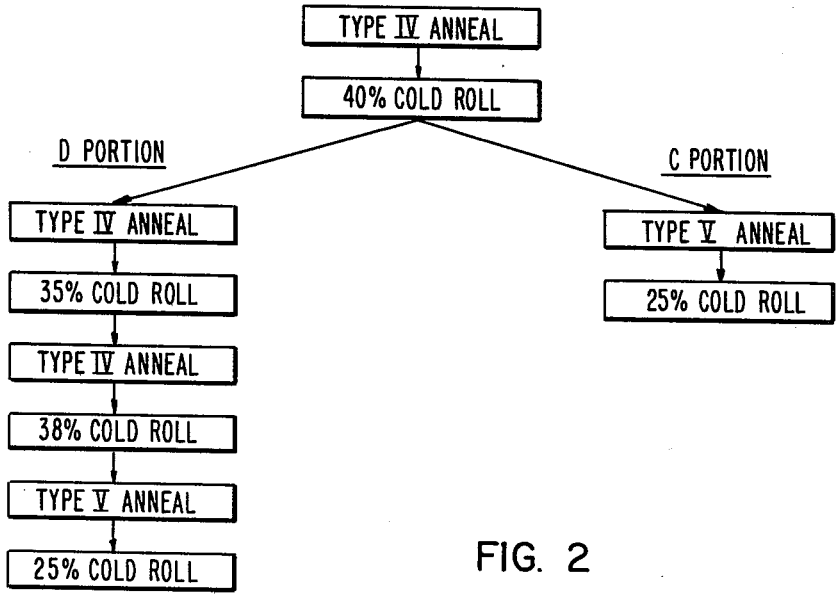
FIG. 2 shows a flow diagram of an embodiment of the D57B material processing.

An ingot of D57B Material having the chemistry shown in Table I was cast and then worked into a bar of approximately 1.3 inch in diameter. This material was then rolled at 1150° C. with reheats after each pass to thicknesses of 0.238, 0.150 and 0.067 inches. The 0.067 inch hot rolled material was then sandblasted, pickled and processed as shown in FIG. 2. This material first received a TYPE 4 anneal in which the material is soaked at about 1025° C. for approximately 10 minutes and then air cooled. Subsequently the material was given a 40% cold rolling reduction, after which it was sectioned into portions, D and C. The D portion received the processing showed in the lefthand column of FIG. 2. It was given a Type 4 anneal, followed by cold rolling 35 percent, another Type 4 anneal, and then 38 percent cold rolling reduction. The final anneal this material received was a Type 5 anneal in which the material is soaked at about 1025° C. for about 5 minutes and then air cooled. This annealed material was then cold rolled 25% to a final sheet thickness of about 0.012 inch.

The C portion of the material was processed as shown in the righthand column of FIG. 2. It received a Type 5 anneal followed by a cold rolling reduction of 25% to a final size of about 0.030 inches. Flat tensile specimens having a gauge length of 0.8 inches, and a minimum gauge width of 0.06 inches were cut from the final C portion cold rolled sheet and tested at a cross head speed of 0.020 inch/minute at the various temperatures shown in Table III.

As finally cold rolled, the C portion material microstructure was characterized by a final grain size of approximately ASTM 5 to 6, and was essentially free of laves phase precipitates, the precipitates which act as the primary ferritic alloy strengthener in the D57 and D57B type delta ferritic alloys.

The preceding embodiments of the invention may be modified as needed within the scope of the claims to fabricate the various shapes and sizes of components needed for liquid metal fast breeder reactor and steam generator components. It is specifically contemplated that rolling reductions may be replaced by drawing and/or pilgering operations to produce tubing. It is also contemplated that the initial cold reduction, and, in some cases, subsequent cold reductions, may be replaced by elevated temperature reductions, at up to approximately 500° C., preferably below about 350° C., in order to assure fabricability to the desired final shape and dimensions, while maintaining the essentially laves phase precipitate free, dislocated structure of the final component.

TABLE I

HIGH STRENGTH FERRITIC ALLOYS (weight percent; balance essentially iron)

| Alloy | C | Mn | Si | Cr | Ni | Mo | Nb | V | Ti | Al | B | Zr | N | P | S |
|---|---|---|---|---|---|---|---|---|---|---|---|---|---|---|---|
| D57 | | | | | | | | | | | | | | | |
| Nominal | .05 | 0.4 | 0.3 | 10.5 | *— | 6.0 | 0.5 | 0.3 | — | — | — | — | — | — | |
| Analysis | .055 | 0.45 | 0.31 | 10.5 | *— | 5.96 | 0.54 | 0.33 | — | — | — | — | .048 | .013 | .007 |
| D57B | | | | | | | | | | | | | | | |
| Nominal | .05 | .5 | .3 | 10.5 | .5 | 6.0 | .5 | .4 | — | — | — | — | — | — | — |
| Analysis | .041 | .49 | .34 | 10.25 | .61 | 6.22 | .51 | .4 | .02 | .05 | .001 | .01 | — | — | — |

*Dashed lines indicate elements considered to be impurities in the nominal compositions and impurity elements not analyzed in the chemical analysis.

TABLE II

ALLOY D57 SWELLING CHARACTERISTICS

| | MATERIAL CONDITION Annealed & Aged | | MATERIAL CONDITION Annealed & Cold Worked | |
|---|---|---|---|---|
| Temp. °C. | Fluence (n/sq. cm) | Percent Swelling | Fluence (n/sq. cm) | Percent Swelling |
| 400 | | | $8.4 \times 10^{22}$ | −0.69 |
| 427 | $9.8 \times 10^{22}$ | +0.52 | $10.2 \times 10^{22}$ | −0.70 |
| 454 | | | $7.4 \times 10^{22}$ | −0.76 |
| 482 | $9.1 \times 10^{22}$ | +0.07 | $9.6 \times 10^{22}$ | −0.92 |
| 510 | | | $11.5 \times 10^{22}$ | −1.22 |
| 538 | $11.0 \times 10^{22}$ | −0.43 | $11.3 \times 10^{22}$ | −0.74 |
| 593 | $12.1 \times 10^{22}$ | −0.20 | $12.2 \times 10^{22}$ | −0.78 |
| 649 | | | $12.1 \times 10^{22}$ | −0.89 |

TABLE III

TENSILE PROPERTIES OF COLD ROLLED D57-B (UNIRRADIATED)

| | 0.2% Offset Yield Strength | | Ultimate Strength | | Elongation, % | | Reduction | Hardness |
|---|---|---|---|---|---|---|---|---|
| Temp °C. | ksi | MPa | ksi | MPa | Uniform | Total | in Area, % | DPH |
| RT | 105.0 | 723.9 | 111.1 | 766.0 | — | 4.0 | 64.4 | 250 |
| 232 | 97.5 | 672.2 | 97.5 | 672.2 | 0.7 | 3.6 | 69.0 | |

TABLE III-continued

TENSILE PROPERTIES OF COLD ROLLED D57-B (UNIRRADIATED)

| Temp °C. | 0.2% Offset Yield Strength ksi | 0.2% Offset Yield Strength MPa | Ultimate Strength ksi | Ultimate Strength MPa | Elongation, % Uniform | Elongation, % Total | Reduction in Area, % | Hardness DPH |
|---|---|---|---|---|---|---|---|---|
| 400 | 91.4 | 630.2 | 91.8 | 632.9 | 1.0 | 3.0 | 63.7 | |
| 450 | 89.0 | 613.6 | 89.3 | 615.7 | 1.0 | 4.1 | 56.4 | |
| 500 | 82.4 | 568.1 | 84.0 | 579.2 | 1.1 | 4.9 | 57.6 | |
| 550 | 77.1 | 531.6 | 81.8 | 564.0 | 2.2 | 5.5 | 67.8 | |
| 600 | 69.2 | 477.1 | 75.0 | 517.1 | 4.5 | 8.0 | 57.3 | |
| 650 | 67.8 | 467.5 | 74.8 | 515.7 | 10.7 | 13.0 | 69.2 | |

I claim:

1. A process for treating a precipitation hardening ferritic alloy comprising the steps of:

solution treating said alloy;

followed by a final cold working of said alloy;

and then placing said alloy in said alloy intended application, wherein the first significant precipitation hardening of said alloy after said final cold working step is induced.

2. A process for treating a precipitation hardening ferritic alloy according to claim 1 wherein said precipitation hardening is induced by exposing said alloy at an elevated temperature to neutron radiation.

3. The process according to claim 1 or 2 wherein said alloy comprises:

chromium-about 9. to 13 wt.%;

molybdenum-about 4. to 8 wt.%;

silicon-about 0.2 to 0.8 wt.%;

manganese-about 0.2 to 0.8 wt.%;

carbon-about 0.04 to 0.12 wt.%;

iron-essentially the balance.

4. The process according to claim 3 wherein said alloy further comprises:

vanadium-about 0.1 to 0.3 wt.%;

niobium-about 0.2 to 0.8 wt.%.

5. The process according to claim 1 or 2 wherein said alloy comprises:

chromium-about 9.5 to 11.5 wt.%;

molybdenum-about 5.5 to 6.5 wt.%;

silicon-about 0.2 to 0.5 wt.%;

manganese-about 0.3 to 0.6 wt.%;

carbon-about 0.04 to 0.07 wt.%;

and iron-essentially the balance.

6. The process according to claim 5 wherein said alloy further comprises:

vanadium-about 0.1 to 0.3 wt.%;

and niobium-about 0.3 to 0.6 wt.%.

7. The process according to claim 3 wherein said alloy further comprises:

nickel-about 0.1 to 1.0 wt.%.

8. The process according to claim 6 wherein said alloy further comprises:

nickel-about 0.4 to 0.6 wt.%.

9. The process according to claim 1 or 2 wherein said final cold working step comprises about a 10 to 50 percent reduction in the cross section of said alloy.

10. The process according to claim 9 wherein said percent reduction is approximately 25 percent.

11. The process according to claim 3 wherein said cold working comprises about a 10 to 50 percent reduction in cross section.

12. The process according to claim 1 or 2 wherein said alloy is a precipitation hardening delta ferritic alloy.

13. A precipitation hardening ferritic alloy produced in accordance with the process of claim 1 or 2.

14. A heat transfer component for use in a high temperature environment comprising a delta ferritic precipitation hardening alloy having a fully ferritic cold worked microstructure substantially free of precipitation hardening phase.

15. A high temperature structural component comprising a delta ferritic precipitation hardening alloy having a fully ferritic cold worked microstructure substantially free of precipitation hardening phase.

16. The component according to claim 14 or 15 wherein said component precipitation hardens while in use.

* * * * *